US010309187B2

(12) United States Patent
Carragher

(10) Patent No.: US 10,309,187 B2
(45) Date of Patent: Jun. 4, 2019

(54) DOWNHOLE FISHING TOOL

(71) Applicant: BISN TEC LTD., Runcorn, Cheshire (GB)

(72) Inventor: Paul Carragher, Lymm (GB)

(73) Assignee: BiSN Tec Ltd., Warrington (GB)

( * ) Notice: Subject to any disclaimer, the term of this patent is extended or adjusted under 35 U.S.C. 154(b) by 166 days.

(21) Appl. No.: 15/309,789

(22) PCT Filed: Aug. 14, 2015

(86) PCT No.: PCT/GB2015/052346
§ 371 (c)(1),
(2) Date: Nov. 8, 2016

(87) PCT Pub. No.: WO2016/024121
PCT Pub. Date: Feb. 18, 2016

(65) Prior Publication Data

US 2017/0234093 A1 Aug. 17, 2017

(30) Foreign Application Priority Data

Aug. 15, 2014 (GB) ..... 1414565.0

(51) Int. Cl.
*E21B 31/00* (2006.01)
*E21B 33/122* (2006.01)
(Continued)

(52) U.S. Cl.
CPC ..... *E21B 33/122* (2013.01); *E21B 17/042* (2013.01); *E21B 19/00* (2013.01);
(Continued)

(58) Field of Classification Search
CPC ..... E21B 31/00; E21B 31/06; E21B 31/007
See application file for complete search history.

(56) References Cited

U.S. PATENT DOCUMENTS 1,534,229 A * 4/1925 Livergood ..... E21B 31/007 294/86.1
2,686,689 A * 8/1954 Pyke ..... E21B 27/00 166/301

(Continued)

FOREIGN PATENT DOCUMENTS

| | | |
|---|---|---|
| CA | 2592556 | 6/2007 |
| GB | 2016063 | 9/1979 |
| WO | WO 2011/151171 | 12/2011 |

OTHER PUBLICATIONS

International Search Report PCT/GB2015/052346, dated 2016.
PCT/GB2015/052346 Opinion, 2016.

*Primary Examiner* — Yong-Suk Ro
(74) *Attorney, Agent, or Firm* — Glen P. Belvis; Belvis Law, LLC.

(57) ABSTRACT

An oil or gas well fishing tool (60). The downhole fishing tool (60) has a receptacle (61) that is open at one end. The tool also has deployment tool engaging means (62), located on the opposite end of the receptacle (61) to the one end. The tool further has a layer of an alloy (64) provided on the interior surface of the receptacle (61). The alloy is a eutectic alloy and/or a bismuth alloy. The tool further comprises heating means (65) to heat the alloy (64) so that it melts and can flow over any object received within the receptacle (61).

13 Claims, 4 Drawing Sheets

(51) Int. Cl.

| | |
|---|---|
| ***E21B 29/10*** | (2006.01) |
| ***E21B 17/042*** | (2006.01) |
| ***E21B 33/13*** | (2006.01) |
| ***E21B 41/00*** | (2006.01) |
| ***E21B 19/00*** | (2006.01) |
| ***E21B 33/14*** | (2006.01) |
| ***E21B 43/10*** | (2006.01) |

(52) U.S. Cl.
CPC ..... *E21B 29/10* (2013.01); *E21B 31/007* (2013.01); *E21B 33/13* (2013.01); *E21B 33/14* (2013.01); *E21B 41/00* (2013.01); *E21B 43/10* (2013.01)

(56) References Cited

U.S. PATENT DOCUMENTS

| | | | | | |
|---|---|---|---|---|---|
| 2,789,004 | A | * | 4/1957 | Foster | E21B 31/007 164/332 |
| 2,822,876 | A | | 2/1958 | Murrow | |
| 3,119,451 | A | | 1/1964 | Hall | |
| 3,170,516 | A | | 2/1965 | Corley | |
| 3,208,530 | A | | 9/1965 | Allen | |
| 3,871,315 | A | * | 3/1975 | Andersen | B63C 7/16 114/51 |
| 4,134,452 | A | | 1/1979 | Kingelin | |
| 4,423,783 | A | | 1/1984 | Haag | |
| 4,487,747 | A | * | 12/1984 | Robinson | C01G 1/06 423/60 |
| 4,488,747 | A | | 12/1984 | Austin | |
| 4,523,640 | A | | 6/1985 | Wilson | |
| 4,696,343 | A | | 9/1987 | Anderson | |
| 5,052,489 | A | | 10/1991 | Carisella | |
| 5,564,861 | A | | 10/1996 | Khudenko | |
| 6,102,120 | A | | 8/2000 | Chen | |
| 6,454,001 | B1 | | 9/2002 | Thompson | |
| 6,474,414 | B1 | | 11/2002 | Gonzalez | |
| 6,664,522 | B2 | | 12/2003 | Spencer | |
| 6,828,531 | B2 | | 12/2004 | Spencer | |
| 6,923,263 | B2 | | 8/2005 | Edin | |
| 7,152,657 | B2 | | 12/2006 | Bosma | |
| 7,290,609 | B2 | | 11/2007 | Wardlaw | |
| 2002/0162596 | A1 | | 4/2002 | Simpson | |
| 2002/0056553 | A1 | * | 5/2002 | Duhon | E21B 36/04 166/302 |
| 2003/0132224 | A1 | | 7/2003 | Spencer | |
| 2004/0261994 | A1 | | 12/2004 | Nguyen | |
| 2005/0109511 | A1 | | 5/2005 | Spencer | |
| 2006/0144591 | A1 | | 7/2006 | Gonzalez | |
| 2007/0051514 | A1 | | 3/2007 | La Rovere | |
| 2010/0006289 | A1 | | 1/2010 | Spencer | |
| 2010/0263876 | A1 | | 10/2010 | Frazier | |
| 2011/0214855 | A1 | | 9/2011 | Hart | |
| 2012/0199351 | A1 | | 8/2012 | Roberston | |
| 2012/0298359 | A1 | | 11/2012 | Eden | |
| 2013/0087335 | A1 | | 4/2013 | Carraher | |
| 2013/0192833 | A1 | | 8/2013 | Gano | |
| 2014/0318782 | A1 | | 10/2014 | Bourque | |
| 2015/0211326 | A1 | | 7/2015 | Lowry | |
| 2015/0211327 | A1 | | 7/2015 | Lowry | |
| 2015/0211328 | A1 | | 7/2015 | Lowry | |
| 2015/0345248 | A1 | | 12/2015 | Carragher | |
| 2015/0368542 | A1 | | 12/2015 | Carragher | |
| 2016/0145962 | A1 | | 5/2016 | Carragher | |
| 2016/0319633 | A1 | | 11/2016 | Cooper | |
| 2017/0030162 | A1 | | 2/2017 | Carragher | |
| 2017/0089168 | A1 | | 3/2017 | Carragher | |
| 2017/0226819 | A1 | | 8/2017 | Carragher | |
| 2017/0234093 | A1 | | 8/2017 | Carragher | |
| 2017/0234100 | A1 | | 8/2017 | Carragher | |
| 2017/0306717 | A1 | | 10/2017 | Carragher | |

* cited by examiner

DOWNHOLE FISHING TOOL

This application claims priority under 35 USC § 371 to International Application No. PCT/GB2015/052346, filed Aug. 14, 2015, which claims priority to GB 1414565.0, filed Aug. 15, 2014.

FIELD OF THE INVENTION

The present invention relates to a downhole fishing tool, and in particular a fishing tool for use in retrieving objects that have become stranded within an oil or gas well.

BACKGROUND OF THE INVENTION

In order to access oil and gas deposits located in underground formations it is necessary to drill bore holes into these underground formation and deploy production tubing to facilitate the extraction of the oil and gas deposits.

Additional tubing, in the form of well lining or well casing, may also deployed in locations where the underground formation is unstable and needs to held back to maintain the integrity of the oil/gas well.

From time to time during the formation, completion and closure of oil and gas wells objects can become stranded within the well. Such objects can include: hand tools (e.g. wrenches); downhole tools; or parts of the casing that have become disconnected from the main casing body.

Due to the limited access available within oil/gas wells, which are generally formed in deep underground formations stranded objects, such as those identified, can obstruct the passage of working equipment through the well and disrupt normal operations. Any disruption to the operation of an oil/gas well can be expensive due to a halt in the extraction of oil/gas.

When objects become stranded downhole fishing tools can be employed to retrieve them from within the well as quickly as possible so that normal operations can be resumed promptly.

However due to the distance between the operator, at the surface, and the stranded object deep within the well the process of fishing the object out can be challenging and time consuming. Also the equipment need for the fishing exercise is expensive.

SUMMARY OF THE INVENTION

The present invention seeks to provide an improved fishing tool that quickly and effectively retrieve stranded objects from downhole locations, and in particular oil and gas wells.

To this end there is provided an oil or gas well fishing tool, said tool comprising: a receptacle that is open at one end; deployment tool engaging means, located on the opposite end of the receptacle to the one end; a eutectic alloy and/or a bismuth based alloy provided within the interior of the receptacle; and heating means to heat the alloy so that it melts.

In the use the fishing tool can be delivered down a well by suitable delivery means (e.g. wire line or coil tubing). The open-ended receptacle of the fishing tool enables the tool to surround the stranded object—which might typically be a tool, such as a wrench, broken downhole tool, damaged fishing neck or a piece of junk.

Once in place on the object the heating means can be operated to heat the layer of alloy provided on the interior of the receptacle for a limited time. This causes the alloy to sag and flow over the object. When the alloy cools it binds the object to the fishing tool, thus enabling the object to be extracted from the well along with the fishing tool.

Preferably the alloy may be provided as a layer of alloy on an interior surface of the receptacle.

Preferably the heating means comprise an ignition means and a layer of a chemical heat source located between the receptacle and the alloy layer. Although alternative heat sources can be employed a chemical heat source, such as thermite, is considered particularly suitable as it enables the fishing tool to be a self-contained unit that does not require an external power source.

Advantageously the fishing tool may further be provided with a spear member located within the receptacle. Further preferably the spear member extends beyond the open-end of the receptacle.

The spear member provides an additional gripping functionality when using the fishing tool to retrieve snapped cable or wireline, for example.

Preferably the receptacle of the fishing tool is substantially bell-shaped.

Alternatively the receptacle may be formed by a combination of a main body and foot section. Further preferably the heating means and the alloy is provided within the main body of the receptacle.

In addition the foot section may comprise additional gripping means. The additional gripping means may take the form of a roughened surface or a surface with a plurality of projections.

Further preferably the foot section may be removable from the main body of the receptacle. In this way it is envisioned that a standard tool might be adapted to form a fishing tool be attaching the foot section to an off-the-shelf tool with an alloy and a heater.

Preferably the alloy has fragments of a second material embedded within it, wherein the melting temperature of the second material is higher that the alloy. In this way the second material can further enhance the gripping effect on the object achieved when the alloy cools. Preferably the second material is a metal or an alloy.

Further preferably the fragments are in the form of fibres or chips.

The present invention also provides a method of retrieving an object lost down an oil or gas well, said method comprising: delivering the fishing tool of the present invention down a well so that it surrounds at least part of the lost object; heating the alloy within the fishing tool and allowing it flow over the object; allowing the alloy to cool before retrieving the fishing tool and the object from the well.

BRIEF DESCRIPTION OF THE DRAWINGS

Preferred embodiments of the present invention will now be described with reference to the drawings, wherein.

DETAILED DESCRIPTION OF THE PREFERRED EMBODIMENTS OF THE PRESENT INVENTION

Figure 1:
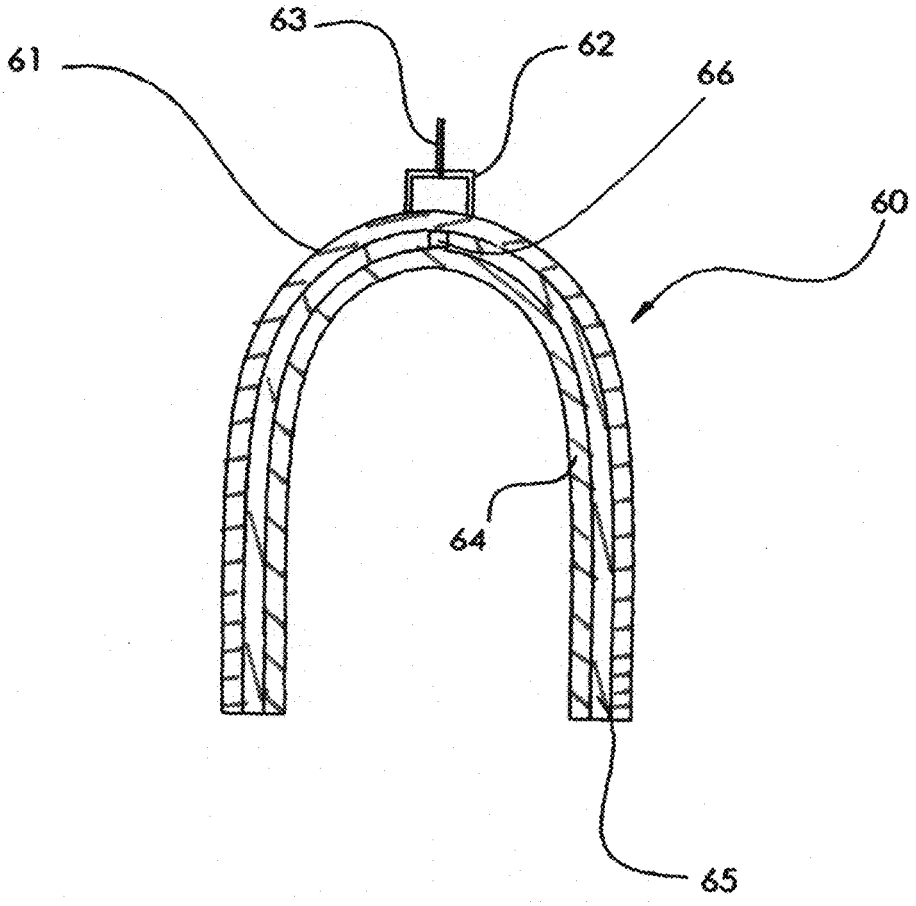
FIG. 1 shows a diagrammatic cross-sectional representation of an embodiment of the fishing tool provided by the present invention.
Figure 2:
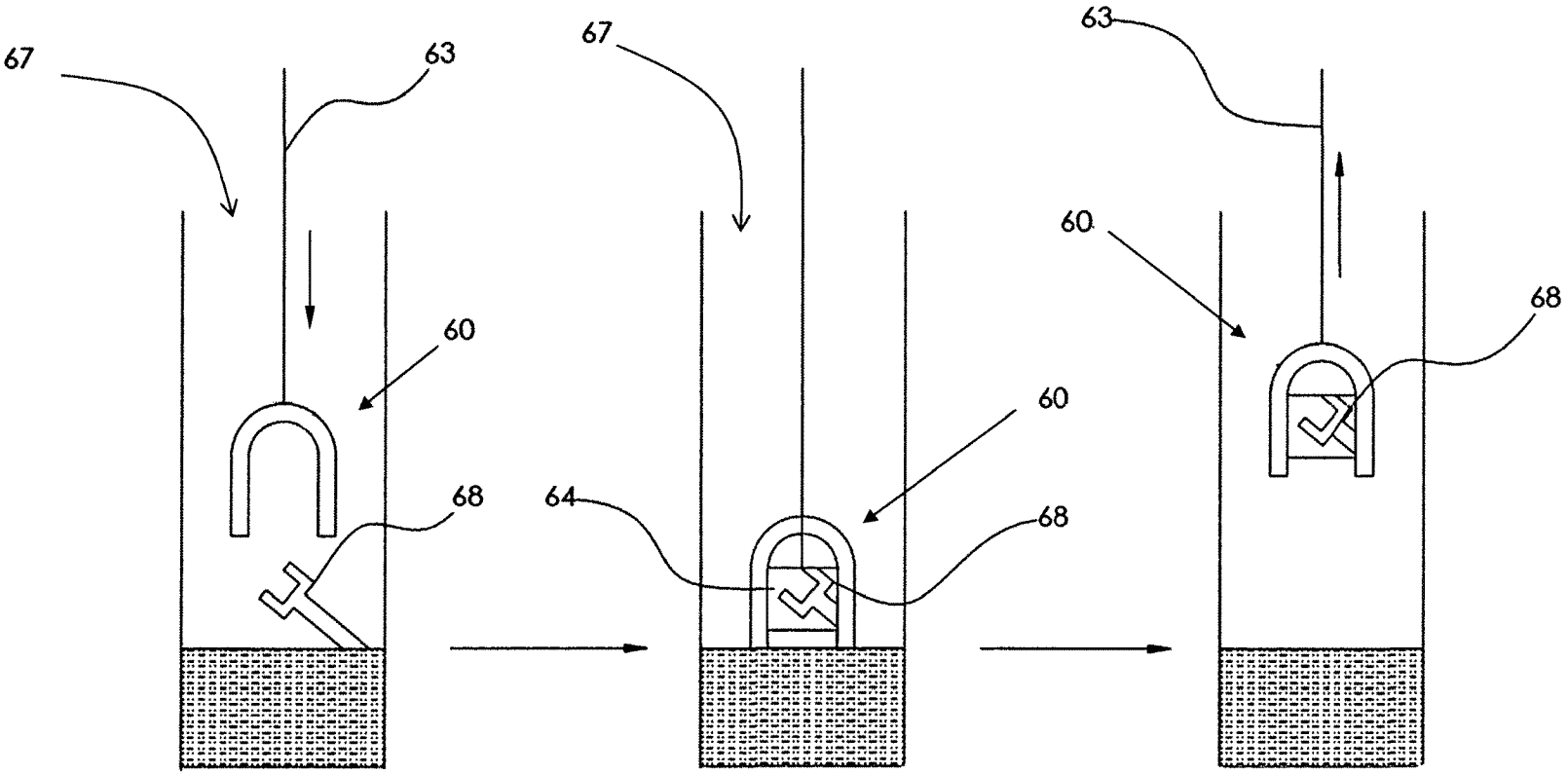
FIG. 2 shows a diagrammatic representation of the key stages of the deployment and operation of the embodiment of the fishing tool of FIG. 1.
Figure 3:
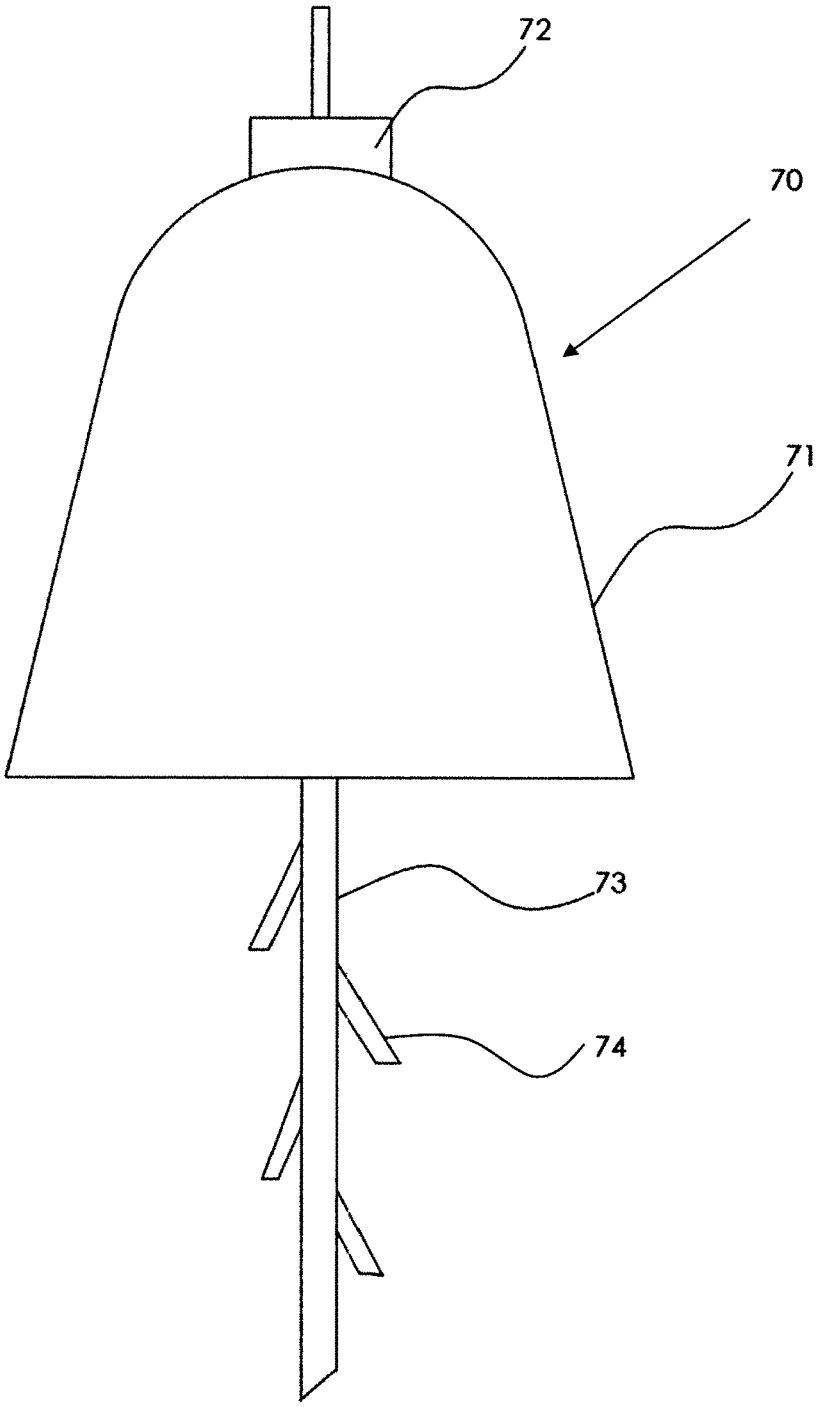
FIG. 3 shows an alternative embodiment of the fishing tool provided by the present invention.

FIGS. 1 and 2 both show a first embodiment of the oil/gas well fishing tool 60 provided according to the present invention, whereas FIG. 3 shows an alternative embodiment of the fishing tool 70.

As described above fishing tools, such as those shown, are employed to retrieve objects that either fall into a well or cannot be retrieved by using their normal retrieval method—for instance a tool attached to a snapped wire line or cable.

As can be seen from the cross-sectional view of the tool 60 provided in FIG. 1, the tool comprises an open-ended receptacle 61 with means 62 for engaging a deployment tool, such as wire line 63, so that the fishing tool 60 can be deployed down a well. In the preferred embodiment the receptacle is substantially 'bell-shaped'. However alternative open-end receptacle shapes, such as boxes and cylinders, could also be employed without departing from the scope of the present invention Located within the inside of the receptacle is a layer of an alloy 64. The alloy is preferably a eutectic alloy, although other non-eutectic alloys formed from bismuth are also considered applicable without departing from the general scope of the present invention.

In order to heat the alloy when needed the tool is also provided with heating means, which in the shown embodiment comprise a layer of chemical heat source 65 (e.g. thermite) provided between the inner surface of the receptacle 61 and the layer of alloy 64. The tool is further provided with ignition means 66, which can be activated via the wire line 63 to trigger the chemical heater and melt the alloy.

In order to further explain the operation of the fishing tool 60 reference is now made to FIG. 2, which show the key stages of the tool's operation.

In the first stage the fishing tool 60 is delivered down a well 67 towards the stranded object (e.g. wrench 68) using, in this example, a wire line 63.

Once the receptacle of the tool 60 has be positioned about at least a portion of the object 68 the heating means are activated for a short period of time to cause the alloy located within the receptacle to melt and sag. As the alloy melts it comes into contact with the object and flows around it. As the heat source has already started to cool the alloy is itself beginning to cool down and solidify.

As the alloy returns to its solid form the object 68 becomes embedded within the solid alloy 64 and in doing so becomes one with the fishing tool 60. The merged fishing tool 60 and object 68 can then be extracted from the well using the wire line 63.

Preferably, although not shown in the figures, the alloy 64 may have fragments of a second material embedded within it. Such material, which is preferably a metal, has a higher melting point that the alloy so that it remains in its solid state when the alloy flows. In this way the fragments, which might be in the form of fibres or chips, enhance the gripping of the object by the alloy as it solidifies.

The fishing tool 70 shown in FIG. 15 is further enhanced by the addition of a spear member 73 which projects from within the open-ended receptacle 71. The spear member 73, which is provided with tines 74 for enhanced gripping, is considered particularly suitable for retrieving snapped wire line and cable from within a well.

Once again the tool is provided with means 72 for engaging a deployment tool.

Figure 4:
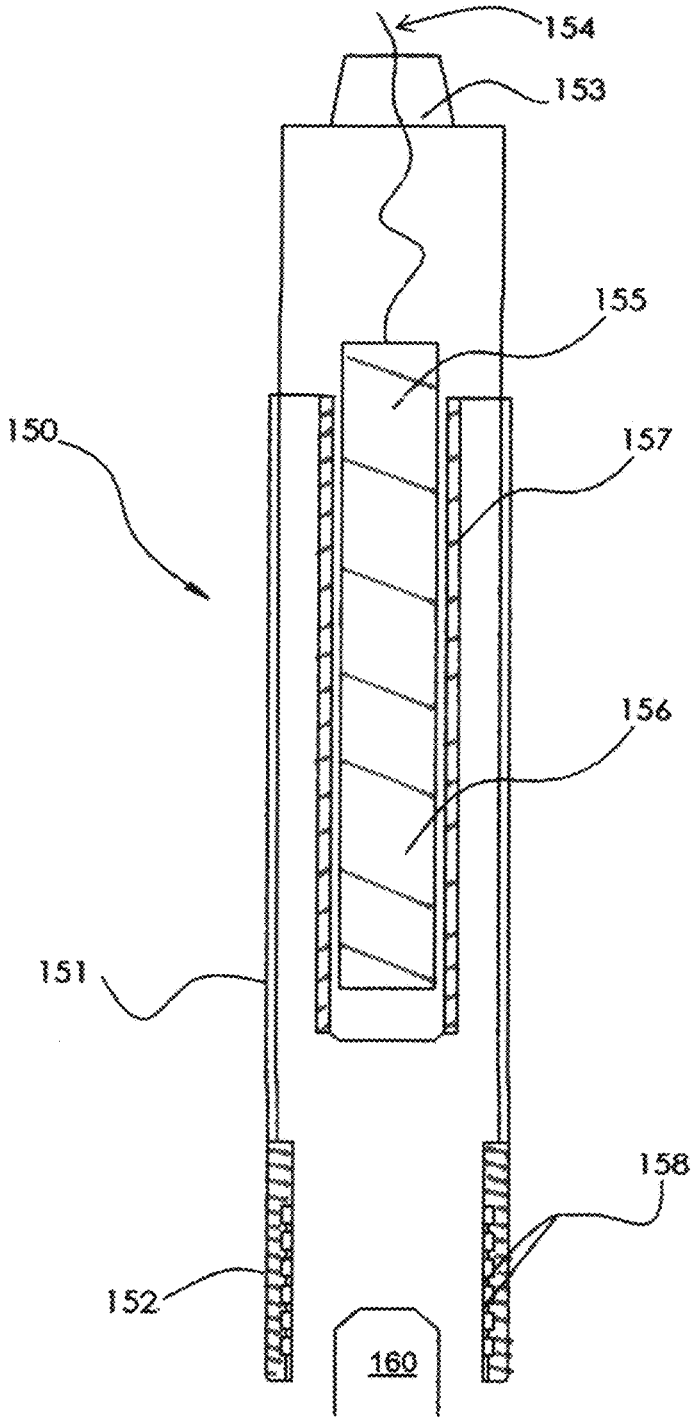
FIG. 4 shows a further alternative embodiment of the fishing tool provided by the present invention.

FIG. 4 shows a further alternative embodiment of the fishing tool of the present invention. The fishing tool 150 is provided with a receptacle that is comprised of two parts, a main body 151 and a removable foot portion 152. The foot portion 152 can be connected to the main body 151 by a screw thread, although alternative means may also be used without departing from the claimed invention.

The main body 151 of the receptacle is provided with means for engaging a deployment tool 153. In FIG. 4 a wire line 154, which attaches the fishing tool 151 to a deployment tool (not shown) located above ground, is also shown in part.

Located within the main body 151 of the receptacle is a heater 155, which is housed with a mandrel 156. The eutectic/bismuth alloy 157 is provided on the surface of the mandrel 156. It is been discovered that by providing clearance between the main body 151 and the alloy 157 it enables the down hole fluids to circulate within the receptacle, which aids the flow of the melted alloy.

The mandrel 156, which in the shown embodiment is located concentric to and entirely within the main body 151, is made from a material with a higher melting point than the alloy 157, suitable examples of which include steel and aluminium. This is also the case for the main body 151 and the foot portion 152.

The foot portion 152 is provided with gripping means 158, in the form of a threaded region. It is envisaged that alternative types of gripping means, such as a roughened surface or a plurality of projections, might be used instead without departing from the general scope of the present invention.

One key feature of the embodiment shown in FIG. 4 is that the foot portion 152 of the receptacle is detachable from the main body 151 of the receptacle. It is envisaged that this facility allows for a range of different shaped foot portions to be attached to the main body to suit the shape/size of the stranded object 160.

The present invention therefore also provide a method of assessing the size and shape of the stranded object in order to select a suitable foot portion for a particular task.

It is appreciated that by having the main components of the fishing tool provided by a standard tool that is connectable to a variety of more tailored foot portions, it is possible to greatly reduce the costs involved in retrieving stranded objects from down a well.

It is appreciated that some variants of the foot portion may be provided with one or more spear members similar to those shown in FIG. 3.

The invention claimed is:

1. An oil or gas well fishing tool, said tool comprising:

a receptacle comprising an interior that is open at one end; thereby defining an open-end of the receptacle;

a deployment tool engaging means, located on the opposite end of the receptacle to the one end;

an alloy provided within the interior of the receptacle, wherein the alloy comprises an eutectic alloy, a bismuth alloy, or both; wherein the alloy is provided on an interior surface of the receptacle; thereby defining an alloy layer on the interior surface of the receptacle; and a heating means to heat the alloy so that the alloy melts;

wherein the heating means comprise an ignition means and a layer of a chemical heat source located between the receptacle and the alloy layer.

2. The fishing tool of claim 1, further comprising a spear member located on or in the receptacle.

3. The fishing tool of claim 2, wherein the spear member extends beyond the open-end of the receptacle.

4. The fishing tool of claim 1, wherein the receptacle is bell-shaped.

5. The fishing tool of claim 1, wherein the receptacle is formed by a combination of a main body and foot section.

6. The fishing tool of claim 5, wherein the heating means and the alloy are provided within the main body of the receptacle.

7. The fishing tool of claim 6, wherein the foot section comprises additional gripping means.

8. The fishing tool of claim 5, wherein the foot portion is removable from the main body of the receptacle.

9. The fishing tool of claim 1, wherein the alloy comprises embedded fragments of a second material, wherein a melting temperature of the second material is higher than a melting temperature of the alloy.

10. The fishing tool of claim 9, wherein the second material is a metal, an alloy or both.

11. The fishing to of claim 9, wherein the fragments are in the form of fibres, chips or both.

12. A method of retrieving an object lost down a gas or oil well, said method comprising:

a) delivering a fishing tool according to any of claims 1 to 11 down a well so that the fishing tool surrounds at least part of a lost object; the fishing tool comprising:

i. a receptacle comprising an interior that is open at one end; thereby defining an open-end of the receptacle;

ii. a deployment tool engaging means, located on the opposite end of the receptacle to the one end;

iii. an alloy within the interior of the receptacle, wherein the alloy comprises a eutectic alloy, a bismuth alloy, or both; wherein the alloy is provided on an interior surface of the receptacle; thereby defining an alloy layer on the interior surface of the receptacle; and iv. a heating means to heat the alloy so that the alloy melts;

wherein the heating means comprise an ignition means and a layer of a chemical heat source located between the receptacle and the alloy layer;

b) heating the alloy within the fishing tool and allowing the alloy flow over the object; and c) allowing the alloy to cool before retrieving the fishing tool and the object from the well.

13. The method of claim 12, further comprising the steps of assessing the size and shape of the stranded object and then selecting a foot portion suitable to retrieve the object.

* * * * *